252-99 AU 157 EX
5/13/86 OR 4,588,515

United States Patent [19]
Schuh et al.

[11] Patent Number: 4,588,515
[45] Date of Patent: May 13, 1986

[54] GRANULAR AUTOMATIC DISHWASHER DETERGENT COMPOSITIONS CONTAINING SMECTITE CLAY

[75] Inventors: Stephen E. Schuh, Harrison, Ind.; Marla R. Smoot, Florence, Ky.

[73] Assignee: The Procter & Gamble Company, Cincinnati, Ohio

[21] Appl. No.: 655,383

[22] Filed: Sep. 27, 1984

[51] Int. Cl.[4] ..... C11D 9/42
[52] U.S. Cl. ..... 252/99; 252/95; 252/140; 252/174.21; 252/174.25
[58] Field of Search ..... 252/113, 120, 121, 128, 252/131, 140, 155, 173, 174.21, 174.25, DIG. 14

[56] References Cited

U.S. PATENT DOCUMENTS 3,314,891 4/1967 Schmolka et al. ..... 252/89
4,005,027 1/1977 Hartmann ..... 252/95
4,062,647 12/1977 Storm et al. ..... 8/137
4,101,457 7/1978 Place et al. ..... 252/559
4,116,851 9/1978 Rupe et al. ..... 252/103
4,226,736 10/1980 Bush et al. ..... 252/135
4,465,613 8/1984 Carter ..... 252/174.16

*Primary Examiner*—Paul Lieberman
*Assistant Examiner*—John F. McNally
*Attorney, Agent, or Firm*—Darla P. McVicar; Richard C. Witte; Thomas H. O'Flaherty

[57] ABSTRACT

Granular detergent compositions suitable for use in automatic dishwashing machines are disclosed. The compositions contain detergency builder material, chlorine bleach ingredient, a nonionic surfactant compatible with the chlorine bleach ingredient, and suds control components comprising an alkyl phosphate ester and a smectite clay.

17 Claims, No Drawings

GRANULAR AUTOMATIC DISHWASHER DETERGENT COMPOSITIONS CONTAINING SMECTITE CLAY

BACKGROUND OF THE INVENTION

Field of the Invention

This invention relates to detergent compositions which are particularly suitable for use in automatic dishwashers. Such compositions are normally alkaline and contain detergency builder materials, relatively low levels of low sudsing surfactants and a source of available chlorine.

SUMMARY OF THE INVENTION

This invention is based on modifications in conventional, automatic dishwasher detergent compositions that provide surprisingly effective suds control. In particular the invention relates to a low sudsing granular detergent composition suitable for use in an automatic dishwashing machine comprising:

(1) from about 20% to about 95%, preferably from about 40% to about 90%, by weight of detergency builder material;

(2) chlorine bleach ingredient to provide from about 0.2% to about 5%, preferably from about 1% to about 3%, of available chlorine based on the weight of the detergent composition;

(3) from about 1% to about 15%, preferably from about 2% to about 8%, of low-foaming, nonionic surfactant, preferably one which is solid at 35° C. (95° F.);

(4) from about 0% to about 50%, preferably from about 2% to about 20%, based on the weight of the nonionic surfactant, of alkyl phosphate ester, or mixtures thereof, preferably mono $C_{18}$ alkyl phosphate esters and di $C_{18}$ alkyl phosphate esters; and (5) from about 0.5% to about 5%, preferably from about 1.5% to about 3%, of a smectite clay.

DETAILED DESCRIPTION OF THE INVENTION

Detergency Builder Material

Compositions of the invention contain from about 20% to about 95%, preferably about 40% to about 90%, by weight of detergency builder material, or mixtures of detergency builders, on an anhydrous basis.

The detergency builder material can be any of the detergent builder materials known in the art which include trisodium phosphate, tetrasodium pyrophosphate, sodium tripolyphosphate, sodium hexametaphosphate, sodium silicates having $SiO_2$:$Na_2O$ weight ratios of from about 1:1 to about 3.6:1, sodium carbonate, sodium hydroxide, sodium citrate, borax, sodium ethylenediaminetetraacetate, sodium nitrilotriacetate, sodium carboxymethyloxysuccinate, sodium carboxymethyloxymalonate, sodium polyphosphonates, sodium polymeric carboxylates such as polyacrylates, and mixtures thereof. The corresponding potassium salts can be used. Preferably, monomeric organic detergency builder materials comprise not more than about 10% of the composition by weight.

Preferred detergency builder materials have the ability to remove metal ions other than alkali metal ions from washing solutions by sequestration, which as defined herein includes chelation, or by precipitation reactions. Sodium tripolyphosphate is a particularly preferred detergency builder material which is a sequestering agent. Sodium carbonate is a preferred precipitation detergency builder and alkalinity source, particularly when it is desirable to reduce the total phosphorous level of the compositions of the invention. Chlorinated trisodium orthophosphate can act as both a chlorine bleach and a precipitation detergency builder material.

The inclusion of water-soluble silicates, especially sodium silicates having $SiO_2$:$Na_2O$ weight ratios of from about 1:1 to about 3.6:1 is a particularly preferred embodiment of the invention. Such silicates are a source of alkalinity useful in the automatic dishwashing process and also act to inhibit the corrosion of aluminum, glassware and ceramic glazes.

Particularly preferred compositions of the invention contain from about 15% to about 50% sodium tripolyphosphate, from about 5% to about 40% of sodium silicate solids as described hereinbefore and from 0% to about 25% sodium carbonate by weight.

Chlorine Bleach Component

The compositions of this invention contain a chlorine bleach ingredient to provide from about 0.2% to about 5%, preferable from about 1% to about 3% of available chlorine based on the weight of the detergent composition.

An inorganic chlorine bleach ingredient such as chlorinated trisodium phosphate can be used, but organic chlorine sources such as the chlorocyanurates are preferred. Alkali metal dichlorocyanurates are particularly preferred, such as sodium or potassium dichlorocyanurate. Sodium dichlorocyanurate dihydrate is especially preferred.

Methods of determining "available chlorine" of compositions incorporating chlorine bleach materials such as hypochlorites and chlorocyanurates are well known in the art. Available chlorine is the chlorine which can be liberated by acidification of a solution of hypochlorite ions (or a material that can form hypochlorite ions in solution) and at least a molar equivalent amount of chloride ions. A conventional analytical method of determining available chlorine is addition of an excess of an iodide salt and titration of the liberated free iodine with a reducing agent.

The Nonionic Surfactant

The compositions of the invention contain from about 1% to about 15%, preferably from about 2% to about 8%, of a low-foaming nonionic surfactant which is preferably solid at 35° C. (95° F.), more preferably solid at 37.78° C. (100° F.). A highly preferred surfactant is an ethoxylated nonionic surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkylphenol on an average basis.

A particularly preferred ethoxylated nonionic surfactant is derived from a straight chain $C_{16-20}$ alcohol, preferably a $C_{18}$ alcohol, condensed with an average of from about 6 to about 15 moles, preferably from about 7 to about 12 moles, and most preferably from about 8 to about 9 moles of ethylene oxide per mole of alcohol. Preferably the ethoxylated nonionic surfactant so derived has a narrow ethoxylate distribution relative to the average.

The ethoxylated nonionic surfactant can optionally contain propylene oxide up to about 15% by weight of the surfactant and retain the advantages hereinafter described. A preferred surfactant of the invention can be prepared by the processes described in U.S. Pat. No. 4,228,163, Guilloty, issued Sept. 16, 1980, incorporated herein by reference.

The surfactants of the invention in combination with the other components of the composition provide excellent cleaning and outstanding performance from the standpoints of absence of residual spotting and filming. In these aspects, the surfactants of the invention provide generally superior performance relative to ethoxylated nonionic surfactants with hydrophobic groups other than monohydroxy alcohols and alkylphenols, for example, polypropylene oxide or a polymer derived from propylene oxide in combination with diols, triols and other polyglycols or polyamines.

Importantly, the preferred solid surfactants of the invention can be incorporated in compositions containing alkali metal dichlorocyanurates, or other organic chlorine bleaches, without an interaction that results in loss of available chlorine. The nature of this problem is disclosed in U.S. Pat. No. 4,309,299 issued Jan. 5, 1982 to Rapisarda et al and in U.S. Pat. No. 3,359,207, issued Dec. 19, 1967, to Kaneko et al, both patents incorporated herein by reference.

As disclosed hereinafter, the surfactants of the invention require suds control components for utility in the compositions of the invention.

Alkyl Phosphate Ester

The compositions of the invention contain from about 0% to about 50%, preferably from about 2% to about 20%, based on the weight of the nonionic surfactant of an alkyl phosphate ester or mixtures thereof.

Suitable alkyl phosphate esters are disclosed in U.S. Pat. No. 3,314,891, issued Apr. 18, 1967, to Schmolka et al, incorporated herein by reference.

Preferred alkyl phosphate esters are monostearyl acid phosphate and monooleyl acid phosphate or salts thereof, particularly alkali metal salts, or mixtures thereof.

The alkyl phosphate esters of the invention have been used to reduce the sudsing of detergent compositions suitable for use in automatic dishwashing machines. The esters are particularly effective for reducing the sudsing of compositions comprising nonionic surfactants which are heteric ethoxylated-propoxylated or block polymers of ethylene oxide and propylene oxide.

Sudsing of the nonionic surfactants of the present invention is reduced by incorporation of the alkyl phosphate esters of the invention, but not always sufficiently to prevent a suds overflow or to maintain optimum spray arm speeds under a wider variety of soil, product usage, machine type and water conditions.

Smectite Clay

The compositions of the invention contain from about 0.5% to about 5.0%, preferably from about 1.5% to about 3.0%, of a smectite clay. In combination with the alkyl phosphate esters of the invention, the smectite clay effectively controls the sudsing of the compositions of the invention under the wide variety of conditions encountered in household use.

Preferred smectite clays are montmorillonites, (including bentonites that comprise substantial amounts of montmorillonite), saponites and hectorites. A more complete discussion of smectite clays is found in U.S. Pat. No. 4,062,647 issued Dec. 13, 1977 to Storm et al, incorporated herein by reference. Preferred smectite clays have an average particle size in the range of from about 0.1 microns to about 10 microns.

Optional Ingredients

In a highly preferred embodiment, the compositions of the invention contain from about 0.25 to about 2.5 moles, preferably from about 0.5 to about 1.5 moles of a water-soluble or water-solubilizable calcium-containing material per mole of alkyl phosphate ester present. The use of calcium-containing material to improve control sudsing of automatic dishwashing detergent compositions is disclosed in the copending, commonly assigned patent application, U.S. Ser. No. 646,611, filed Aug. 31, 1984, now abandoned, by Willian A. Cilley, entitled Granular Automatic Dishwasher Detergent Composition.

China protecting agents including aluminosilicates, aluminates, etc., can be present in amounts of from about 0.1% to about 5%, preferably from about 0.5% to about 2%.

Filler materials can also be present including sucrose, sucrose esters, sodium chloride, sodium sulfate, etc., in amounts from about 0.001% to about 60%, preferably from about 5% to about 30%.

Hydrotrope materials such as sodium benzene sulfonate, sodium toluene sulfonate, sodium cumene sulfonate, etc., can be present in minor amounts.

Dyes, perfumes, crystal modifiers and the like can also be added in minor amounts.

The compositions of the invention can be prepared in any manner that results in formation of a granular product form. The process described in U.S. Pat. No. 2,895,916, Milenkevich et al, July 21, 1959, and variations thereof, are particularly suitable. Also particularly suitable is the process described in U.S. Pat. No. 4,427,417, Porasik, Jan. 24, 1984. Both patents are incorporated herein by reference.

As used herein, all percentages, parts and ratios are by weight unless otherwise stated.

The following Examples illustrate the invention and facilitate its understanding.

EXAMPLE I

A. 33.1 Parts by weight of powdered anhydrous sodium tripolyphosphate and 8.0 parts by weight of hydrous sodium silicate (82% solids, $SiO_2$:$Na_2O$ weight ratio of 2.4) were added to a ribbon mixer. With the mixer in operation the following ingredients were added during a cycle time of 180 seconds.

(a) from 0 seconds to 165 seconds—added as a spray blend of 13.8 parts of an aqueous sodium silicate solution containing 47.3% silicate solids with a $SiO_2$:$Na_2O$ weight ratio of 2.0 and 4.7 parts of an aqueous sodium silicate solution containing 37.5% silicate solids with a $SiO_2$:$Na_2O$ weight ratio of 3.2. This solution also contained minor amounts of perfume and dye.

(b) at 60 seconds—added dry
19.4 parts of sodium sulfate and 10.0 parts of sodium carbonate.

(c) from 60 seconds to 165 seconds—added as a spray
4.0 parts of a polyoxyethylene nonionic surfactant (condensation product of $C_{18}$ alcohol with average of 8.25 moles ethylene oxide) and 0.2 parts of monostearyl acid phosphate.

(d) at 145 seconds—added dry 5.0 parts of sodium chloride having a particle size such that at least 80% passed through a 100 Tyler mesh screen.

(e) after 180 seconds

Product is discharged from mixer.

(f) 2.5 parts of sodium dichlorocyanurate dihydrate was added and mixed in after drying and aging of the product discharged from the mixer at step (e).

B. The process of A was repeated with the addition of 2 parts of a sodium montmorillonite clay (bentonite) having an average particle size of 1μ–10μ replacing 2 parts of sodiudm sulfate in step (b).

C. The processes of A and B were repeated with the addition of 0.2 parts of calcium chloride dihydrate.

Water lost during processing accounts for any excess over 100 parts in the Compositions A and B.

EXAMPLE II

A detergent composition was prepared according to Example IA (Sample #1). Two (2) parts of bentonite clay were then admixed into the same detergent composition to prepare Sample #2, and both samples were tested in a popular brand automatic dishwashing machine.

| | Hardness | Usage | % Wash Efficiency | Suds Overflow (ml) |
|---|---|---|---|---|
| Sample #1 | 0–2 gr. | 12 gms. | 18 | 530 |
| no clay | 0–2 gr. | 24 gms. | 42 | 300 |
| | 0–2 gr. | 48 gms. | 12 | 960 |
| | 0–2 gr. | 72 gms. | 78 | 840 |
| Sample #2 | 0–2 gr. | 12 gms. | 100 | 0 |
| 2 parts | 0–2 gr. | 24 gms. | 93 | 15 |
| bentonite clay | 0–2 gr. | 48 gms. | 52 | 165 |
| | 0–2 gr. | 72 gms. | 74 | 240 |

EXAMPLE III

A detergent composition was prepared according to EXAMPLE IA (Sample #1). Two (2) parts of bentonite clay were then admixed with the same detergent composition to prepare Sample #2, and the samples were tested in a popular brand automatic dishwashing machine.

| | Hardness | Usage | % Wash Efficiency | Suds Overflow (ml) |
|---|---|---|---|---|
| Sample #1 | 0–2 gr. | 12 gms. | 57 | 115 |
| no clay | 0–2 gr. | 24 gms. | 39 | 305 |
| | 0–2 gr. | 48 gms. | 29 | 610 |
| | 0–2 gr. | 72 gms. | 25 | 650 |
| Sample #2 | 0–2 gr. | 12 gms. | 100 | 0 |
| 2 parts | 0–2 gr. | 24 gms. | 74 | 85 |
| bentonite clay | 0–2 gr. | 48 gms. | 46 | 235 |
| | 0–2 gr. | 72 gms. | 46 | 300 |

EXAMPLE IV

A detergent composition was prepared according to Example IA (Sample #1). Two (2) parts of bentonite clay were then admixed with Sample #1 to provide Sample #2. The samples were tested in a popular brand automatic dishwashing machine at 100° F.

| | Hardness | Usage | % Wash Efficiency | Suds Overflow (ml) |
|---|---|---|---|---|
| Sample #1 | 0–2 gr. | 12 gms. | 92 | 45 |
| no clay | 0–2 gr. | 24 gms. | 63 | 210 |
| | 0–2 gr. | 48 gms. | 48 | 330 |
| | 0–2 gr. | 72 gms. | 19 | 660 |
| Sample #2 | 0–2 gr. | 12 gms. | 100 | 10 |
| 2 parts | 0–2 gr. | 24 gms. | 100 | 15 |
| bentonite clay | 0–2 gr. | 48 gms. | 66 | 100 |
| | 0–2 gr. | 72 gms. | 66 | 150 |

As can be seen from the results of the tests in Examples II–IV, the clay provides improved suds control. Surprisingly, the clay did not adversely effect the cleaning.

What is claimed is:

1. A low sudsing granular detergent composition suitable for use in an automatic dishwashing machine comprising:

(a) from about 20% to about 95% by weight of detergency builder material;

(b) chlorine bleach ingredient to provide from about 0.2% to about 5% of available chlorine based on the weight of the detergent composition;

(c) from about 1% to about 15% of a low-foaming nonionic surfactant;

(d) from about 1% to about 50%, based on the weight of the nonionic surfactant of alkyl phosphate ester or mixtures thereof; and (e) from about 0.5% to about 5% of a smectite clay.

2. The composition of claim 1 wherein said smectite clay comprises a clay selected from the group consisting of montmorillonites, bentonites, saponites and hectorites.

3. The composition of claim 1 containing from about 1.5% to about 3% of a smectite clay.

4. The composition of claim 2 wherein said smectite clay has an average particle size in the range of from 0.1μ to 10μ.

5. The composition of claim 2 containing from about 1.5% to about 3% of said smectite clay.

6. The composition of claim 1 wherein the said nonionic surfactant comprises a surfactant derived from the reaction of a monohydroxy alcohol or alkylphenol containing from about 8 to about 20 carbon atoms, excluding cyclic carbon atoms, with from about 6 to about 15 moles of ethylene oxide.

7. The composition of claim 1 additionally comprising from about 0.25 moles to about 2.5 moles of a water-soluble calcium salt per mole of alkyl phosphate ester present.

8. The composition of claim 5 wherein said water-soluble calcium salt is calcium chloride.

9. The composition of claim 1 where the low-foaming nonionic surfactant is solid at 35° C. (95° F.).

10. A low-sudsing granular detergent composition suitable for use in an automatic dishwashing machine comprising:

(a) from about 40% to about 90% of detergency builder material;

(b) from about 2% to about 8% of an ethoxylated nonionic surfactant derived from a straight chain alcohol with from about 16 to about 20 carbon atoms condensed with an average of from about 7 to about 12 moles of ethylene oxide per mole of said alcohol;

(c) an alkali metal dichlorocyanurate, or hydrate thereof, to provide from about 1% to about 3% of available chlorine based on the weight of the detergent composition;

(d) from about 2% to about 20%, based on the weight of the ethoxylated nonionic surfactant, of an alkyl phosphate ester comprising an alkyl phosphate ester or diester containing from about 16 to about 20 carbon atoms, or the monovalent salts thereof, or hydrates thereof; and (e) from about 1.5% to about 3% of a smectite clay.

11. The composition of claim 10 wherein said smectite clay comprises a clay selected from the group consisting of montmorillonites, bentonites, saponites and hectorites.

12. The composition of claim 11 wherein said smectite clay has an average particle size in the range of from 0.1μ to 10μ.

13. The composition of claim 10 additionally comprising from about 0.25 to about 2.5 moles of a water-soluble calcium salt per mole of alkyl phosphate ester present.

14. The composition of claim 13 wherein said calcium salt is calcium chloride.

15. The composition of claim 10 wherein said ethoxylated nonionic surfactant comprises a surfactant derived from a straight chain monohydroxy $C_{18}$ alcohol, condensed with an average of from about 8 to about 9 moles of ethylene.

16. The composition of claim 10 wherein said alkali metal dichlorocyanurate comprises sodium dichloroisocyanurate dihydrate, potassium dichlorosiocyanurate dihydrate and mixtures thereof.

17. The composition of claim 10 wherein said detergency builder material comprises a material selected from the group consisting of sodium tripolyphosphate, sodium carbonate, sodium silicate, hydrates thereof, and mixtures thereof.

* * * * *